United States Patent [19]

Sabbioni et al.

[11] Patent Number: 4,867,082

[45] Date of Patent: Sep. 19, 1989

[54] ELECTRONIC DEVICE FOR AUTOSETTING CONTROL IN INDUSTRIAL SEWING MACHINES

[75] Inventors: Roberto Sabbioni, Novara; Massimo Sormani, Milan, both of Italy

[73] Assignee: Rockwell-Rimoldi, S.p.A., Milan, Italy

[21] Appl. No.: 242,060

[22] Filed: Sep. 8, 1988

[30] Foreign Application Priority Data

Jun. 7, 1988 [IT] Italy ..... 20879 A/88

[51] Int. Cl.[4] ..... D05B 19/00; D05B 27/04; D05B 27/08

[52] U.S. Cl. ..... 112/121.11; 112/313; 112/235; 112/254

[58] Field of Search ..... 112/313, 314, 315, 235, 112/254, 255, 121.11, 312, 319, 320, 454

[56] References Cited

U.S. PATENT DOCUMENTS 4,108,090 8/1978 Landau, Jr. et al. ..... 112/121.11
4,214,540 7/1980 Cook ..... 112/235
4,301,978 11/1981 Herr et al. ..... 112/254
4,412,498 11/1983 Scholl ..... 112/313
4,726,309 2/1988 Popp ..... 112/313

FOREIGN PATENT DOCUMENTS 1595593 8/1977 United Kingdom ..... 112/454

*Primary Examiner*—Peter Nerbun
*Attorney, Agent, or Firm*—Laff, Whitesel, Conte & Saret

[57] ABSTRACT

The invention herein described comprises a programmable microprocessor control unit 2 controlling a plurality of actuators 6, 7, 8, 9, 10, respectively associated with the differential feed dog, main feed dog and upper feed dog and/or with the presser foot and the tension group of an industrial sewing machine 5. On the basis of the adjustment parameters keyed-in in said control unit, each actuator individually causes the adjustment of the movements of each feed dog, of the pressure exerted by the presser foot and of the force causing the dish-shaped elements of the tension group to be moved close to each other to retain the threads interposed therebetween.

8 Claims, 4 Drawing Sheets

ELECTRONIC DEVICE FOR AUTOSETTING CONTROL IN INDUSTRIAL SEWING MACHINES

BACKGROUND OF THE INVENTION

1. Field of the Invention

The present invention relates to the technical field of control apparatus for industrial sewing machines and more particularly to an electronic device for autosetting control in industrial sewing machines comprising a microprocessor control unit provided with a nonvolatile storage and respective key-controlled panel. Through said keys, it is possible to key in the values of the control parameters for the operation of the differential feed dog, the main feed dog and upper feed dog or of the presser foot and the tension group, acting on an equal number of actuator means respectively.

2. Prior Art

It is known that in the field of textile machines the automatization of all production processes has not yet been achieved.

In greater detail in the field of industrial sewing machines the possibility of changing the machine setting for the different types of workings is becoming increasingly more necessary. That is to say it is often necessary to modify the position and/or operation of some elements of the sewing machine depending upon the type of workpiece to be sewn and the working cycle to be performed thereon.

Said elements consist for example of the differential feed dog, the main feed dog, the upper feed dog or the presser foot and the tension group.

The differential feed dog is an element which by an elliptical movement performs the function of shirring or stretching the fabric being worked depending upon the cases, acting in synchronism with the main feed dog designed to define the stitch length. The differential and main feed dogs operate through the workpiece supporting table under the workpiece to cause the latter to move forward along the supporting table.

The upper feed dog is a further element cooperating with the differential and main feed dogs to assist the forward movement of the workpiece. The presser foot is a plate-like element acting upon the workpiece to ensure the grasping and pulling action of the differential and main feed dogs.

Finally, the tension group essentially consists of a number of take-up members each of them engaging one of the needle threads to cause the appropriate tensioning thereof.

At the present state of the art, these members are manually adjusted by means of adjustment screw means and/or linkages fixed to predetermined positions by suitable locking fingers. In greater detail, the elliptical movement of the differential and main feed dogs can be adjusted by linkages allowing the adjustment of the respective strokes. On the contrary the upper feed dog movements and the load on the presser foot are adjusted by acting on threaded fits connected to a drive rod.

Each of said take-up members can be in turn be adjusted by acting on a threaded finger to vary the preloading of a spring acting on dish-shaped elements between which the needle threads pass.

As previously said, all the above adjustments can be achieved only manually and therefore they involve long down times each time the machine must be set for a new working cycle.

It is also to be noted that in many cases the machine setting needs the intervention of a skilled person, which increases the service costs.

SUMMARY OF THE INVENTION

Consequently it is an object of the present invention to eliminate the drawbacks of the known art by providing a sewing machine in which the setting can be achieved in a completely automatic manner and directly on the work spot.

The foregoing and still further objects which will become more apparent in the course of the present description are substantially attained by an electronic device for autosetting control in industrial sewing machines, of the type comprising a number of actuator means to adjust the movements of the differential feed dog, main feed dog and upper feed dog, as well as of the pressure exerted by the presser foot and the tensioning carried out by the tension group, said actuator means being operated by a microprocessor control unit provided with a nonvolatile storage, characterized in that each of said actuator means for the differential feed dog, main feed dog and upper feed dog comprises a direct current motor cooperating with a potentiometer connected in a circuit to the control unit via an analog-to-digital converter which converts the analog signal of the potentiometer into an electric digital signal, said analog signal being determined by the angular rotation value to which the direct current motor is subjected, in that the actuator means for the presser foot comprises a proportional pneumatic pressure meter connected in a circuit to the control unit through an A/D converter which converts the analog signal of the pressure meter into an electric digital signal, said analog signal being determined by the electric value to which the pressure meter is subjected, and in that the tension group comprises a proportional magnet connected in a circuit to the control unit through an A/D converter which converts the analog signal of the proportional magnet into an electric digital signal, said analog signal being determined by the electric value to which said magnet is subjected.

BRIEF DESCRIPTION OF THE DRAWINGS

Further features and advantages will best be understood from the detailed description of a preferred embodiment of an electronic device for autosetting control in industrial sewing machines, in accordance with the present invention, given hereinafter by way of non-limiting example with reference to the accompanying drawings, in which.

DESCRIPTION OF THE PREFERRED EMBODIMENT

Figure 5:
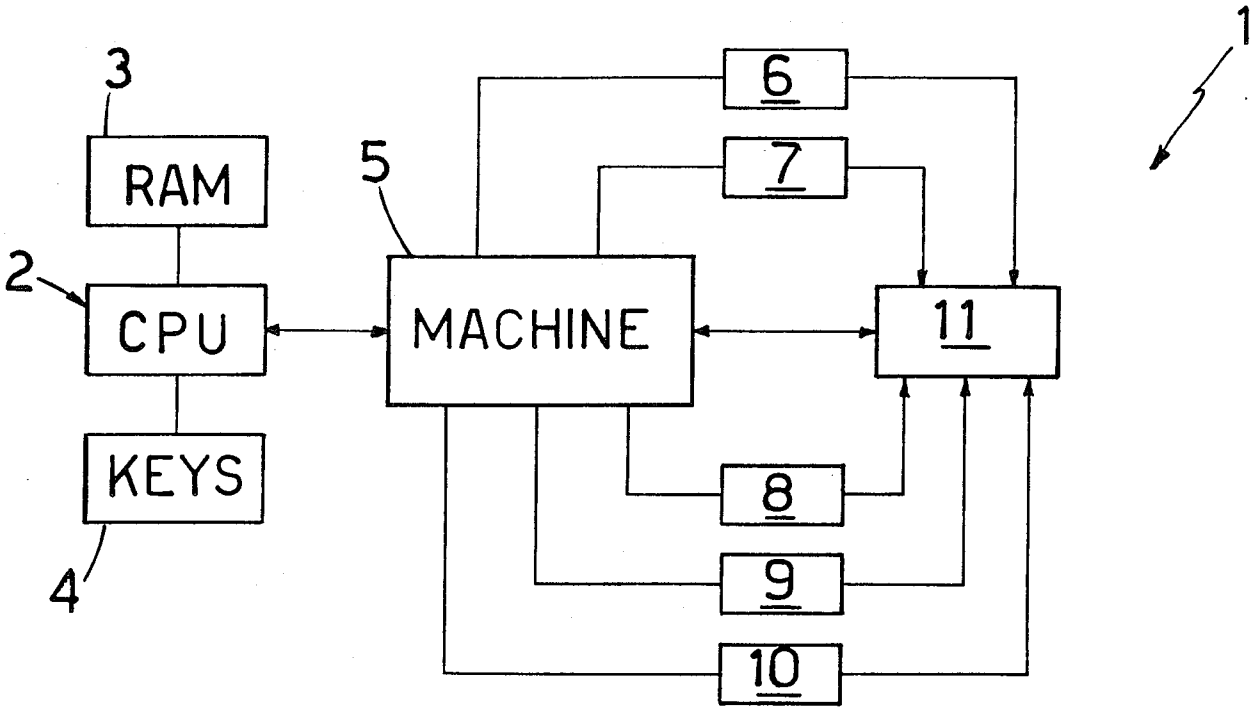
FIG. 5 is a general block diagram of the device of the invention.

Referring to FIG. 5, a plurality of circuit connections between the different elements included in the device has been identified by reference numeral 1. In greater detail, 2 denotes a microprocessor control unit provided with a nonvolatile storage 3 and a key control panel 4. The control unit 2 is associated with at least a sewing machine 5 which is provided with actuator means in accordance with the invention through which it is possible to achieve the autosetting of the machine.

In greater detail, said actuator means, progressively identified by reference numerals 6 to 10, are designed to adjust the operation of the differential and main feed dogs, upper feed dog, presser foot and tension group respectively in a sewing machine 5. Actuator means 6, 7, 8, 9 and 10 are interfaced with the control unit 2 by an A/D converter, identified at 11, which converts the analog signals it receives from said actuator means into digital signals, as more clearly described in the following.

In order to best clarify the interconnection between the different circuit connections and actuating devices 6, 7, 8, 9, 10, reference will be made to FIGS. 1 to 4.

Figure 1:
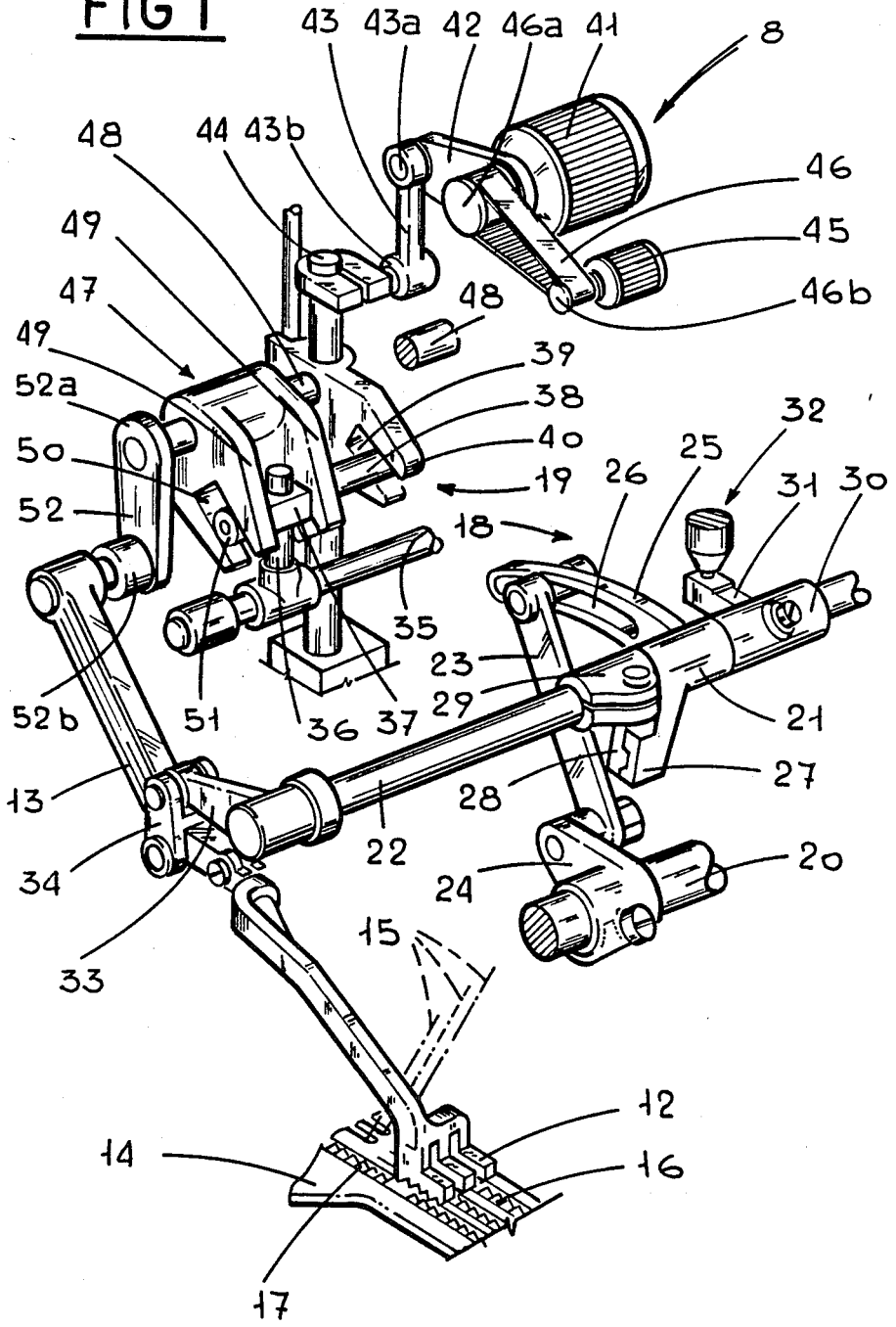
FIG. 1 is a perspective view showing the driving mechanisms of the upper feed dog with which an actuator being part of the device of the invention is associated.
Figure 2:
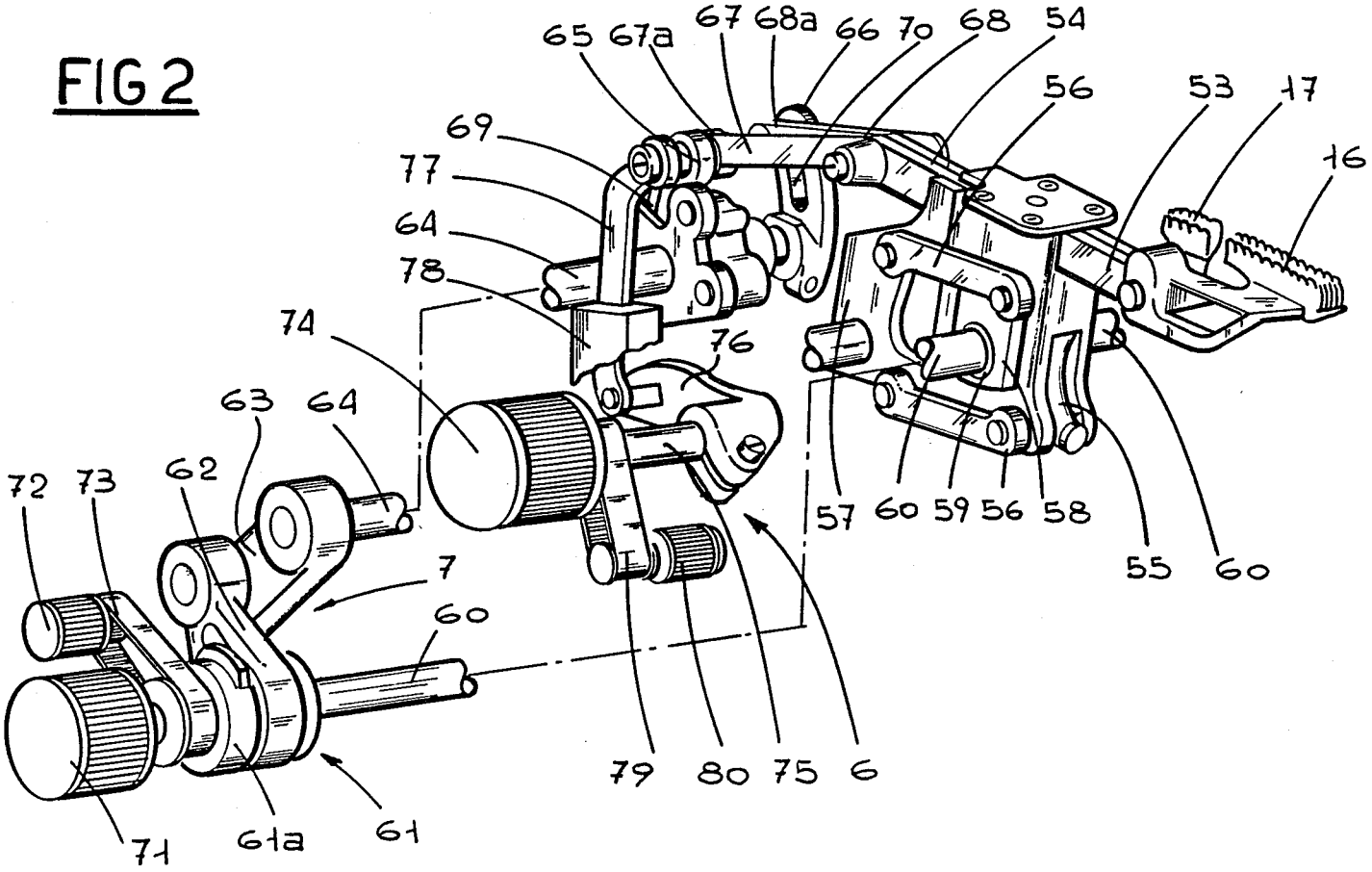
FIG. 2 is a perspective view in split of the driving mechanisms of the differential and main feed dogs, associated with the respective actuator means provided in the device of the invention.

In known manner, as shown in FIGS. 1 and 2, the sewing machine 5 is provided with the differential and main feed dogs acting close to the needle plate, with an upper feed mechanism comprising an upper feed dog operating upon the needle plate. The upper feed dog is actuated so that it may cooperate with the other feed dogs to cause the pulling of the fabric being worked towards the needle or needles while a line of stitching is being performed.

To this end, the upper feed dog is operated according to a substantially elliptical path of movement, due to the combination between a vertical driving mechanism and a horizontal driving mechanism. These driving mechanisms act in synchronism on a support shank of the upper feed dog so that the latter may receive an oscillatory motion in a substantially vertical direction and in a substantially horizontal direction respectively.

In greater detail, referring particularly to FIG. 1, the upper feed dog identified at 12, is supported by a support shank 13 extending upwardly therefrom. The upper feed dog 12 performs an oscillatory movement over a needle plate 14 partially, shown, as well as, with reference to the fabric feed advance direction, either before or behind one or more needles provided with a reciprocating motion and moving through the needle plate 14 according to a path schematically shown in dotted line at 15.

In operation, the upper feed dog 12 is designed to cooperate with the lower feed dogs, that is the differential and main feed dogs, 16 and 17 respectively, which move through the needle plate 14 in known manner.

To this end, the operation of the upper feed dog is controlled by the cooperation between a vertical driving mechanism 18 and a horizontal driving mechanism 19. The vertical driving mechanism 18, in known manner, acts upon an intermediate portion of shank 13 so that it imparts a reciprocating movement in a substantially vertical direction to the upper feed dog 12.

To this end, the vertical driving mechanism 18 comprises a first drive shaft 20 performing an oscillatory movement about its own axis upon the action of drive means being part of the sewing machine and not shown as known and conventional. The first drive shaft 20 transmits its oscillatory movement to an idler sleeve 21 mounted on a first support shaft 22, in turn rotatably supported by a fixed part of the sewing machine. To this end the drive shaft 20 is provided to be operatively connected to sleeve 21 through a connecting rod 23 —crank 24 assembly, where the connecting rod 23 is pivoted to a swinging arm 25 extending from sleeve 21. The pivoting point of the connecting rod 23 can be moved along a slot 26 formed longitudinally in the arm 25 and then fixed to the desired location, the extent of the displacements carried out by the upper feed dog 12 in a vertical direction being dependent on said location.

Furthermore a thrust element 27 extends from sleeve 21 and comes in contact with an abutment element 28 carried by a first hub 29 fitted on the support shaft 22. Also fitted on said support shaft is a second hub 30 provided with a second abutment element 31 on which spring means 32 schematically shown acts. Due to the presence of said spring means the support shaft 22 tends to rotate in such a manner that it causes the first abutment element 28 to be urged towards the thrust element 27.

Still referring to FIG. 1, it is also possible to see that the support shaft 22 is connected to the upper feed dog 12 through a lift arm 33 to the free end of which a connecting element 34 is pivoted which rotatably supports the shank 13 of the upper feed dog 12.

During the operation of the vertical driving mechanism 18 the oscillatory movement of the first drive shaft 20 is transmitted to the first support shaft 22 through the cooperation between the thrust element 27 acting on the abutment element 28 and the spring means 32 acting on the second abutment element 31. The oscillatory motion thus imparted to the support shaft 22 is then converted into a substantially vertical oscillation by the upper feed dog 12 through the lift arm 33 and the connecting element 34.

The horizontal driving mechanism 19 in turn comprises a second drive shaft 35 also performing an oscillatory movement about its own axis in a manner known per se. Radially extending from said shaft 35 is a rod 36 along which a slider 37 is slidably engaged. The latter is provided with a projecting portion which in this example consists of a stem 38 slidably engaging in a guide seat 39 formed in a support element 40.

In an original manner and according to the present invention, the actuator means 8 acting on said support element 40, determines the extent of the horizontal stroke of the upper feed dog 12 by lowering and raising the support itself.

It can be noted that said actuator means 8 comprises a direct current motor 41 associated with a lift arm 42 connected to the support element 40 through a connecting rod 43 engaging a rod 44 integral to the support element itself. Preferably the rod ends are connected to the lift arm 42 and rod 44 respectively by means of respective ball joints **43*a* and 43*b***.

The direct current motor 41 cooperates with a potentiometer 45 connected to the control unit 2 through said A/D converter 11 which converts the analog signal it receives from said potentiometer into a digital signal. Preferably potentiometer 45 is connected to motor 41 by a toothed belt 46 trained around respective pulleys **46*a* and 46*b* adjusted in such a manner that the movement imparted to pulley 46*a* by motor 41 is transmitted to the pulley 46*b* of the potentiometer at a ratio higher than 1**.

The movements imparted to the support element 40 through the lift arm 42 bring about the corresponding displacement of slider 37 along the rod 36. In this manner slider 37 can take different positionings which, as more clearly seen in the following, correspond to the extent of the movements transmitted to the feed dog 12 by the horizontal driving mechanism 19.

The horizontal driving mechanism 19 further comprises a fork-shaped element 47 fitted on a second support shaft 48 parallel to the drive shaft 35 and in turn rotatably supported by a fixed part of the sewing machine.

The fork-shaped element 47 comprises a pair of parallel arms 48 disposed symmetrically to rod 36. Formed in each of said arms 49 is a slide seat 50 extending substantially according to a predetermined angle with respect to the direction perpendicular to the plane in which the axes of the drive and support shafts 35 and 48 lie.

Each slide seat 50 slidably engages a thrust element 51 carried by slider 37.

The horizontal driving mechanism 19 is connected to the upper feed dog 12 through a crank arm 52 one end **52*a* of which is fitted on the support shaft 48 and the opposite end 52*b* of which is rotatably engaged with the free end of the supporting shank 13**.

During the operation of the horizontal driving mechanism 19 the oscillatory motion of the drive shaft 35 is suitably transmitted to the support shaft 48 by virtue of the cooperation between the slider 37 and the fork-shaped element 47 and is then transmitted, in the form of a substantially horizontal oscillatory movement, to rod 13 and therefore to the upper feed dog 12 by the crank arm 52.

It is to be noted that the extent of the oscillations imparted to slider 37 by the drive shaft 35 is proportional to the distance between the slider and the axis of the drive shaft. On the contrary, the oscillations transmitted by slider 37 to the support shaft 48 are inversely proportional to the distance between the slider and the axis of said shaft. As a result, when slider 37 is close to shaft 35 the oscillations transmitted to the support shaft 48 will be of little importance compared to said oscillations corresponding to the minimum stroke performed in a horizontal direction by the upper feed dog 12. On the contrary, when slider 37 is close to the free end of rod 36, the extent of the oscillations transmitted to the support shaft 48 will be maximum compared to said oscillations corresponding to the maximum stroke carried out in operation by the upper feed dog 12.

The positioning of slider 37 and therefore the length of the horizontal stroke performed by the feed dog 12 is controlled by direct current motor 41 which by causing the angular oscillations of the lift arm 42, makes the support element 40 which is moved by rod 44, to shift the slider 37 along rod 36.

The signal transmitted by potentiometer 45 to the control unit 2 enables the latter to identify the slider positioning on rod 36 and therefore cause the stopping of motor 41 when the requested positioning has been reached, as well as to maintain the attained positioning by keeping motor 41 running.

As previously said, the dialogue between the potentiometer 45, and consequently the motor 41, and the control unit 2 is carried on through the A/D converter 11 which converts the analog signal of the potentiometer itself into a digital signal, which analog signal is determined by the angular value of rotation to which said direct current motor 41 is subjected.

Reference is now made to FIG. 2. The differential and main feed dogs 16 and 17 are mounted on respective support rods 53, 54 slidably engaged through a lift gate 55 oscillatably connected, by connecting rods 56 forming a linkage parallelogram, to a fixed frame 57. Engaged in the lift gate 55 is a control block 58 rotatably housing an eccentric 59 mounted on a primary shaft 60 rotating about its own axis.

The rotation imparted to the eccentric 59, upon the action of the primary shaft 60, through block 58 and lift gate 55, gives a vertical oscillatory motion to both differential and main feed dogs, 16 and 17. Oscillations of feed dogs 16 and 17 in a horizontal direction are driven by a driving mechanism comprising a stitch-adjusting eccentric 61 mounted on the primary shaft 60 and acting on a connecting rod 62 in turn acting on a swinging arm 63 associated with a countershaft 64 extending parallel to the primary shaft 60. Fixed to the countershaft 60 are first and second arms 65, 66 connected, through respective driving connecting rods 67 and 68, to the support rods 53, 54 of the differential feed dog 16 and main feed dog 17.

Each driving connecting rod 67 and 68 is engaged with its respective arm 65, 66 in the region of a slot 69, 70, formed in the arm itself. By varying the positionings of the ends **67*a*, 68*a* of said connecting rods 67, 68 along the respective slots 69, 70 it is possible to vary the extent of the horizontal stroke performed by feed dogs 16 and 17 in operation. In this connection it is however to be pointed out that in the embodiment herein described this possibility is exploited only as regards the differential feed dog 16, through actuator means 6, whereas the oscillations of the main feed dog 17 are controlled by actuator means 7**.

In greater detail, actuator means 7 comprises a direct current motor 71 acting on an adjustment cam **61*a* being part of the stitch-adjusting eccentric 61. In known manner, by rotating the adjustment cam 61*a* it is possible to accomplish a variation in the amplitude of the oscillations transmitted from connecting rod 62 to countershaft 64 and consequently feed dogs 16 and 17**.

As hereinbefore described with reference to motor 41 associated with actuator means 8, a potentiometer 72 is associated with motor 71 through a toothed belt 73, at a gear ratio higher than 1. The potentiometer 72 carries on a dialogue through A/D converter 11, with the control unit 2 so that said control unit may cause the motor stopping when, based on an electric signal of the potentiometer, it detects that the desired adjustment of the main feed dog stroke has been attained.

Actuators means 6 for the adjustment of the differential feed dog stroke in turn comprises a direct current motor 74 adapted to rotate a driving spindle 75 carrying a forked element 76. The forked element 76 through a connecting lever 77 engaged with a guide 87, acts on the end **67*a* of the driving connecting rod 67 associated with the differential feed dog 16. The angular rotations imparted to the driving spindle 75 cause a rising or lowering in the forked element which results in a displacement of end 67*a* along slot 69 and consequently a variation in the horizontal stroke of the differential feed dog 16**.

Also associated with motor 74 through a toothed belt 79 having a gear ratio higher than 1, is a respective potentiometer 80 electrically connected to the control unit 2, through A/D converter 11. Based on the electrical signal of potentiometer 80, the control unit is capable of establishing when the desired positioning of end 67*a* in slot 69 has been achieved and, as a result, the desired adjustment of the horizontal stroke of the differential feed dog 16.

Figure 3:
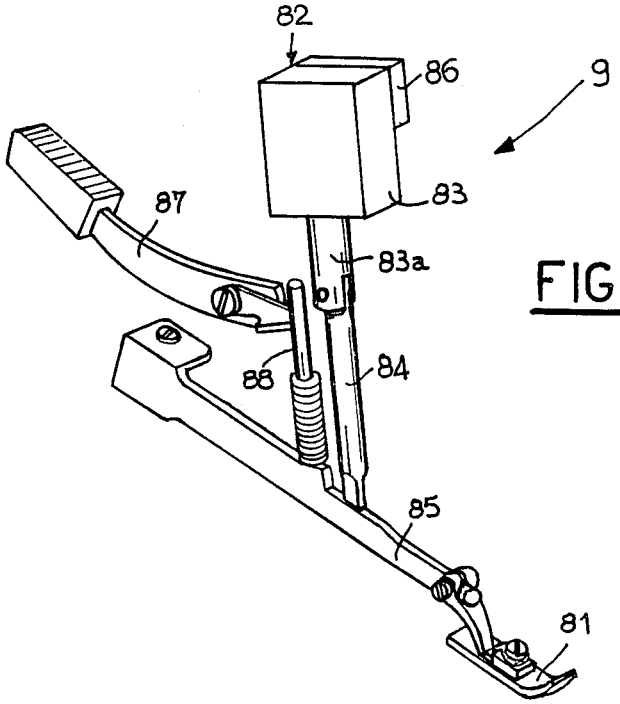
FIG. 3 is a perspective view of the presser foot associated with the respective actuator means according to the invention.

Referring now to FIG. 3, the actuator means 9 relating to the presser foot identified at 81 comprises a proportional pressure meter 82 essentially comprised of a pneumatic cylinder 83 the rod of which 83*a*, through the interposition of a further rod 84, acts on a presser bar 85 oscillatably connected to the sewing machine structure and holding the presser foot 81. Associated with the pneumatic cylinder 83 is a proportional valve 86 connected in a circuit to the control unit 2 through A/D converter 11. Through the A/D converter 11 the proportional valve 86 receives an electric pulse from the control unit 2 and on the basis of said pulse it controls the feeding of the pneumatic cylinder 83 and consequently the pressure exerted by the presser foot 81 on the workpiece, upon the action of the pneumatic cylinder itself.

Optionally, the proportional valve 86 can send a signal to the control unit 2 so that the latter may detect that the adjustment of the presser foot pressure has taken place.

Figure 4:
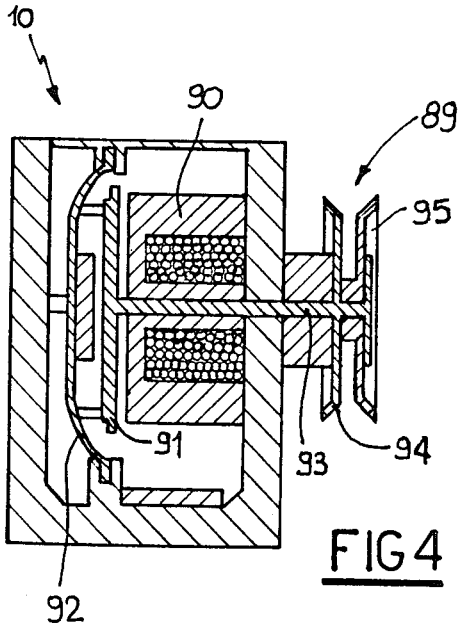
FIG. 4 is a longitudinal sectional view of a take-up member associated with a respective actuator.

Also shown in FIG. 3 is, by way of example, a lift mechanism for the presser foot 81, which substantially consists of a lever 87 pivoted to a fixed part of the sewing machine and adapted to be manually operated to cause the lifting of the presser foot 81, through a rod 88 connected to the presser bar 85. FIG. 4 shows the structure of the actuator means 10 associated with the tension group of the sewing machine 5.

Said actuator means 10 consists of a take-up member identified at 89 and associated with a proportional electromagnet 90 acting on a control dish-shaped element 91 acted upon by a dynamometric spring 92. The dish-shaped element 91 is connected to a movable dish 94 through a rod 93 crossing the magnet 90, said movable dish being urged against an abutment dish 95 upon the action of said spring 92.

In operation, magnet 90 is energized with a suitable current value so that it attracts the dish 91 according to a predetermined force which is added to the force due to the action of spring 92. The tensioning of the thread, which in known manner is caused to pass through dishes 94 and 95 depends upon said resultant force.

Magnet 90 is energized by the control unit 2 which, depending upon requirements, sends an electric signal of a predetermined value to the A/D converter 11 in order to achieve the desired pressure on the thread to be tensioned.

In short, the operation of the device of the invention as a whole is as follows.

The values of the desired adjustment parameters relating to the displacements of the different actuator means 6, 7, 8, 9 and 10 are keyed in by means of keys on the control panel 4. Said keyed-in values are stored in the nonvolatile storage 3 (for example of the RAM type with battery) so that they can be retrieved therefrom turn by turn depending upon the requirements of the working cycle to be performed.

The present invention attains the intended purposes.

In fact by the device of the invention it is possible to establish the setting of the sewing machine in advance, by carrying out the requested programming of the values relating to the adjustment parameters for the actuator means concerned with the working cycle to be executed. In this manner the intervention of skilled persons to set the machine is no longer necessary and it is possible to achieve an automatic continuous working without any manual intervention being necessary. In fact each actuator means is arranged in the requested manner as a result of the previously keyed-in programming instructions.

Furthermore the requested programming can be carried out directly on the work spot by the operator.

Obviously modifications and variations as regards both structure and parameters, may be made to the present invention, all falling within the inventive idea characterizing it.

What is claimed is:

1. An electronic device for autosetting control in industrial sewing machines, of the type comprising a number of actuator means to adjust the movements of a differential feed dog, main feed dog and upper feed dog, as well as of the pressure exerted by the presser foot and the tensioning carried out by a tensioning means said actuator means being operated by a microprocessor control unit provided with a nonvolatile storage, wherein each of said actuator means for the differential feed dog, main feed dog, and upper feed dog comprises a direct current motor cooperating with a potentiometer connected in a circuit to the control unit via an analog-to-digital converter which converts the analog signal of the potentiometer into an electric digital signal, said analog signal being determined by the angular rotation value to which the direct current motor is subjected, wherein the actuator means for the presser foot comprises a proportional pneumatic pressure meter connected in a circuit to the control unit through an A/D converter which converts the analog signal of the pressure meter into an electric digital signal, said analog signal of the pressure meter being determined by the electric value to which the pressure meter is subjected, and wherein the tensioning means comprises a proportional magnet connected in a circuit to the control unit through an A/D converter which converts the analog signal of the proportional magnet into an electric digital signal, said analog signal being determined by the electric value to which said magnet is subjected.

2. A device as claimed in claim 1, wherein the direct current motor of said actuator means for the differential feed dog is designed to deliver angular rotation to a driving spindle carrying a fork-shaped element which, through a connecting lever, acts upon one end of a driving connecting rod connected to the differential feed dog, to move said end along a slot formed in an arm integral to a swinging shaft designed to control the horizontal displacements of the differential feed dog.

3. A device as claimed in claim 1, wherein the direct current motor of said actuator means for the main feed dog is designed to deliver rotation to an adjustment cam being part of a stitch-adjusting eccentric which, through a connecting rod acting upon a driving arm, imparts an oscillatory angular movement to a counter-shaft designed to control the horizontal displacements of the main feed dog.

4. A device as claimed in claim 1, wherein the direct current motor of said actuator means for the upper feed dog, through a lift arm connected to a support element, acts upon a slider slidably engaged along a rod carried by a swinging drive shaft, as well as along slide seats provided in a fork-shaped element integral to a support shaft controlling the horizontal displacements of the upper feed dog.

5. A device as claimed in claim 1, wherein each of the potentiometers associated with said actuator means for the differential feed dog. Main feed dog and upper feed dog is drivingly controlled by its respective motor at a gear ratio higher than 1.

6. A device as claimed in claim 1, wherein said proportional pressure meter comprises a pneumatic cylinder acting on a presser bar supporting said pressor foot and cooperating with a proportional valve connected in a circuit to the control unit through an A/D converter.

7. A device as claimed in claim 1, wherein said proportional magnet acts on a drive dish-shaped element connected, through a rod crossing said magnet, to a movable dish which is urged towards an abutment dish upon the action of a spring acting on the drive dish-shaped element, said magnet being energized by an electrical signal sent to the control unit to attract the drive dish-shaped element and consequently vary the load according to which the movable dish is urged against the abutment dish.

8. An electronic device for autosetting control in industrial sewing machines as claimed in claim 1, wherein said microprocessor control unit carries on dialogues with said actuator means through an A/D converter and stores data relating to autosetting programs into a nonvolatile storage of the RAM type.

* * * * *